US006722355B1

(12) United States Patent
Andrews, Jr.

(10) Patent No.: US 6,722,355 B1
(45) Date of Patent: Apr. 20, 2004

(54) PAINTBALL CONTAINER AND METHOD

(76) Inventor: Harlen R. Andrews, Jr., 746 Mountain Park Rd., State Road, NC (US) 28676

( * ) Notice: Subject to any disclaimer, the term of this patent is extended or adjusted under 35 U.S.C. 154(b) by 0 days.

(21) Appl. No.: 10/097,909

(22) Filed: Mar. 14, 2002

(51) Int. Cl.[7] ..... F41B 11/02
(52) U.S. Cl. ..... 124/49; 124/50
(58) Field of Search ..... 124/45, 49, 50, 124/73, 74

(56) References Cited

U.S. PATENT DOCUMENTS 3,263,664 A * 8/1966 Bauer et al.
5,097,816 A 3/1992 Miller
5,166,457 A 11/1992 Lorenzetti
5,285,765 A 2/1994 Lee
5,361,746 A * 11/1994 Szente
5,511,333 A 4/1996 Farrell
5,809,983 A * 9/1998 Stoneking
6,015,058 A 1/2000 Parks
6,055,975 A * 5/2000 Gallagher et al.
6,109,252 A 8/2000 Stevens
6,234,157 B1 5/2001 Parks
6,273,079 B1 * 8/2001 Jzn ..... 124/49

OTHER PUBLICATIONS

U.S. Patent Application Publication No. US2002/0059927 A1 published May 23, 2002, Application No. 09/935,790 filed on Aug. 22, 2001 by Dennis Woods, Sr., ten (10) pages.

* cited by examiner

*Primary Examiner*—John A. Ricci

(57) ABSTRACT

A paintball container is provided having a semi-circular door for fast, efficient loading of paintballs. The container can be in the form of a gun magazine or can be in the form of a pod for supplying paintballs to the magazine. A semi-circular door of the magazine is biased closed with a spring and allows the magazine to be quickly loaded. The magazine includes a door tab attached to the door and a fixed tab attached to a stop which cooperatively engage respectively a fixed tab and a door tab of a paintball pod which is inverted thereon and rotated during magazine loading.

20 Claims, 5 Drawing Sheets

PAINTBALL CONTAINER AND METHOD

FIELD OF THE INVENTION

The invention herein pertains to guns which fire paintballs and particularly pertains to containers for paintballs, namely gun magazines and paintball pods which are engagable for rapid loading.

DESCRIPTION OF THE PRIOR ART AND OBJECTIVES OF THE INVENTION

The use and playing with paintball guns has rapidly increased in recent years with various teams engaging in mock combat. Each player uses, generally a gas powered gun capable of firing spherical liquid-filled projectiles containing a dye or paint which are commonly referred to as "paintballs". As these guns have improved in operation and firing speed, the need has developed for larger gun magazines and for faster reloading. It is usual for combatants to carry a supply or "pod" of paintballs which is used to refill the gun magazine. Conventional paintball pods require some period of time to open and pour the paintballs into the gun magazine. As a combatant can be shot by an opposing player during this loading process and thus be disqualified, it is essential to load the gun magazine as rapidly as possible when it becomes empty without spilling or wasting paintballs in the process.

Thus, in view of the time required and other problems and difficulties associated with conventional pods and reloading processes, the present invention was conceived and one of its objectives is to provide a container for paintballs which includes a substantially semi-circular door which operates for fast loading and unloading and a method of transferring paintballs from one container to another.

It is another objective of the present invention to provide a container for paintballs in which the door is biased in a closed posture.

It is still another objective of the present invention to provide a container in the form of pod having a semi-circular door which allows paintballs to rapidly move therethrough in multiple numbers.

It is yet another objective of the present invention to provide a paintball container in the form of a gun magazine which also includes a semi-circular door and which has a collar extending thereabove.

It is a further objective of the present invention to provide a pod for containing paintballs having a rotatable door for engagement with a gun magazine also having a rotatable door whereby both doors can be opened simultaneously by rotating the pod relative to the magazine for rapid paintball transfer.

Various other objectives and advantages of the present invention will become apparent to those skilled in the art as a more detailed description is set forth below.

SUMMARY OF THE INVENTION

The aforesaid and other objectives are realized by providing a container for paintballs for rapidly loading and unloading paintballs therefrom. The form of the container may be either a magazine for supplying paintballs to the gun breech or may be a pod which can be carried by a player for use in reloading a gun magazine. In magazine form, a semi-circular door and door stop are positioned atop the magazine body with the door biased closed by a resilient member such as an attached coil spring. A collar attached to the body extends above the door for receiving a paintball pod. Both the magazine and the pod have doors and door stops which are generally semi-circular in shape. Upright tabs on the doors are used in rotating the doors around fixed axles to an open position. When the doors are closed, fixed tabs on the stops are radially aligned with the door tabs.

The method to reload a gun magazine by transferring the paintballs allows the pod to be inverted on and positioned against a shoulder within the collar of the gun magazine. Alignment marks on the outer body of the pod and on the outer body of the magazine ensure correct positioning of the pod in the magazine collar. Once so positioned with the respective fixed and door tabs contiguous, the pod is rotated in a clockwise direction whereby the fixed tab of the pod engages the door tab of the magazine, thus opening the door of the magazine. Simultaneously, the fixed tab of the magazine engages the door tab of the pod and prevents the door of the pod from moving relative to the pod, thus opening the door of the pod into coincidental alignment with the door opening of the magazine. Paintballs contained within the body of the pod are thus directed by gravity downward into the body of the magazine in a quick and rapid manner. For example, two hundred (200) balls can be transferred from the pod into the magazine in approximately two to three (2–3) seconds.

Once the balls have been so transferred, the pod is removed from the magazine collar so the gun may resume firing.

DETAILED DESCRIPTION OF THE PREFERRED EMBODIMENTS AND OPERATION OF THE INVENTION

Figure 1:
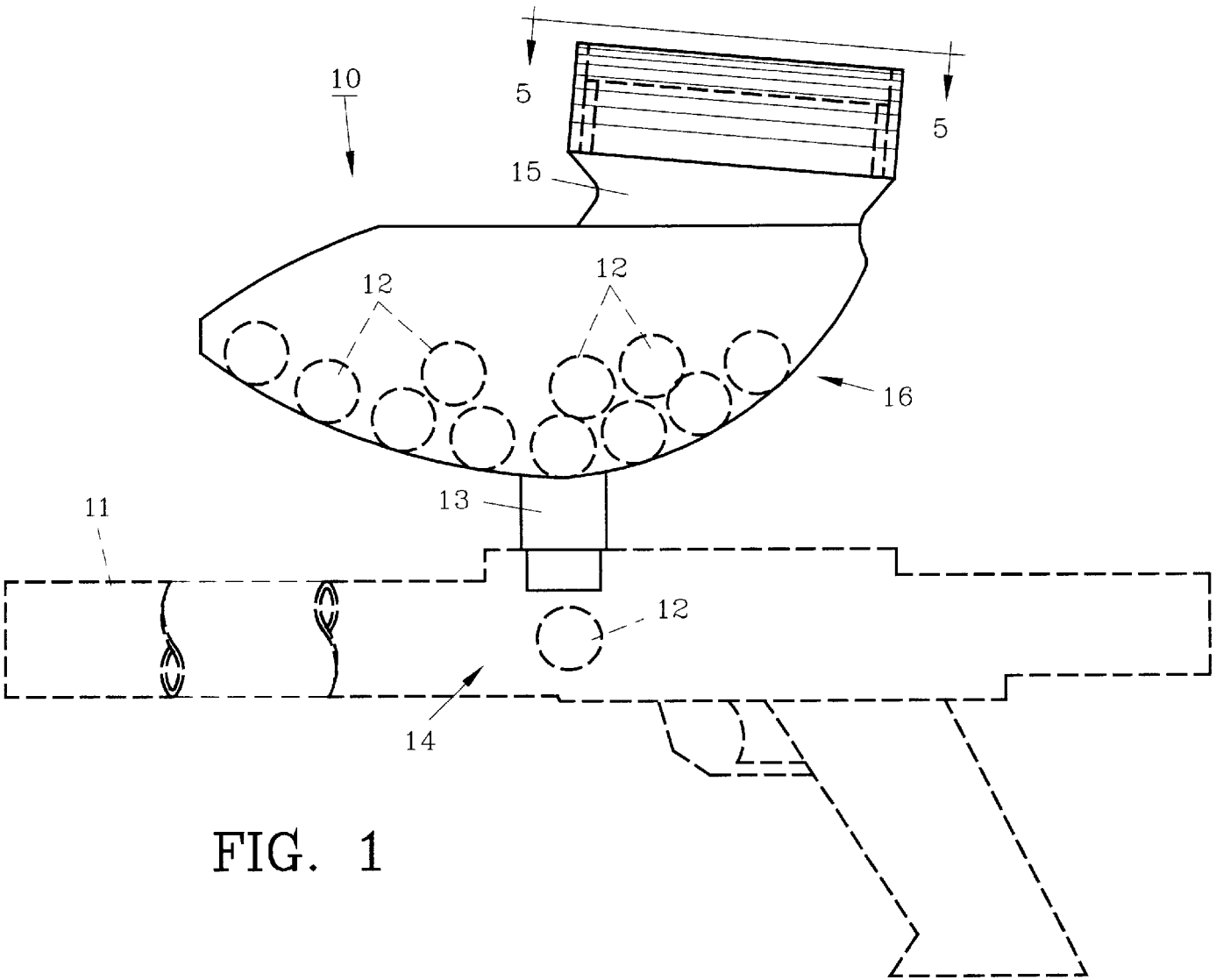
FIG. 1 shows a conventional paintball gun in dashed line fashion with the magazine of the invention in place thereon.

For a better understanding of the invention and its operation, turning now to the drawings, FIG. 1 shows preferred paintball magazine 10 positioned on conventional paintball gun 11 (in dashed line fashion). Magazine 10 acts as a container for paintballs 12 and holds approximately one hundred fifty to two hundred (150–200) standard paintballs 12. As usual, paintballs 12 are gravity fed through tube 13 into breech 14 (generally shown) of paintball gun 11 for firing purposes. While playing tag, war or other games, paintballs 12 are rapidly fired requiring frequent refilling of magazine 10 as earlier mentioned.

Figure 5:
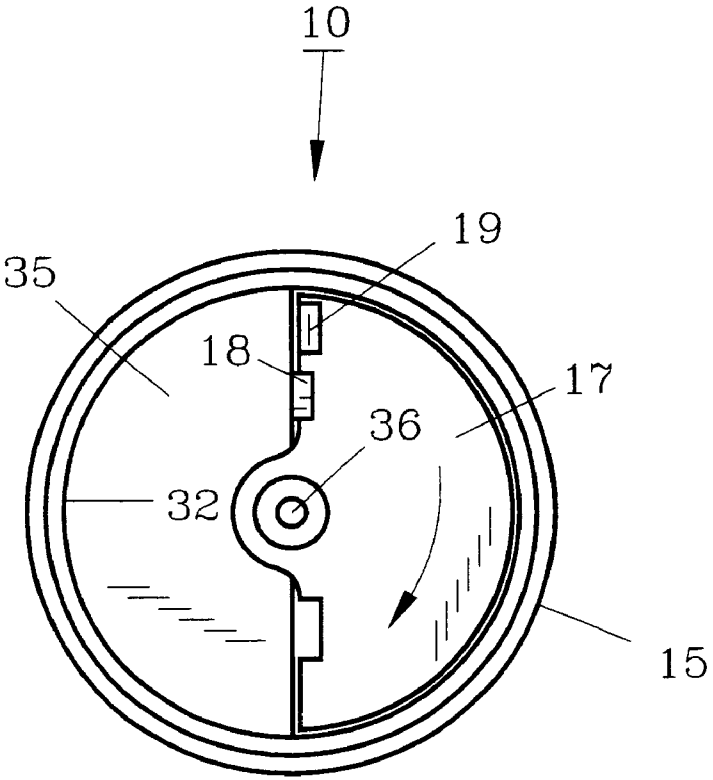
FIG. 5 pictures a top view of the paintball magazine along lines 5—5 of FIG. 1.
Figure 6:
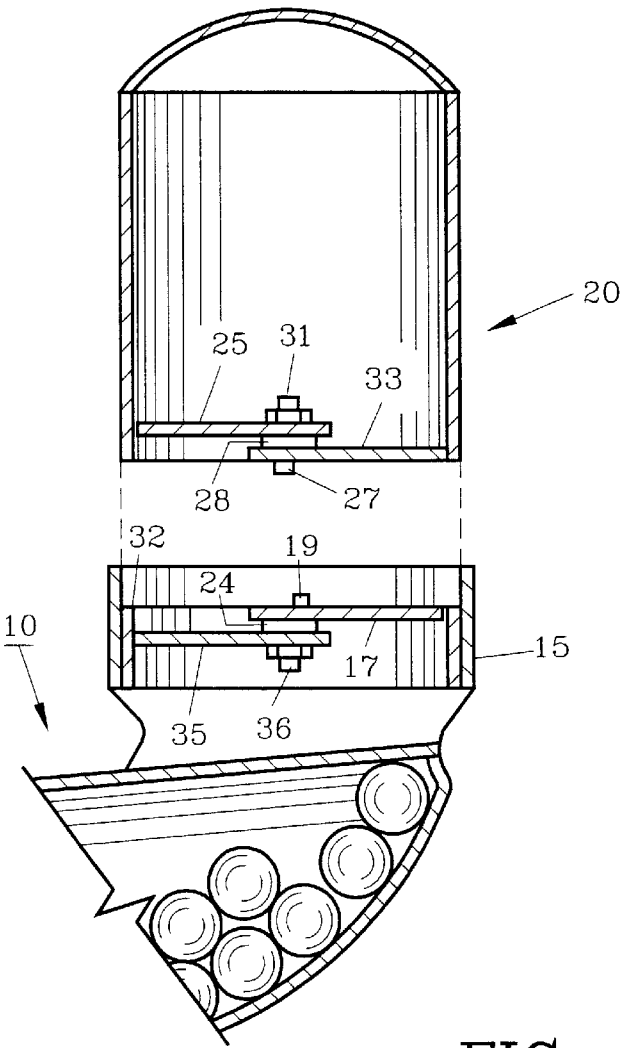
FIG. 6 features a fragmented, cut-away view of the gun magazine and pod prior to engagement in the loading process.

Magazine 10 includes hollow body 16 which is preferably formed of a durable, molded plastic with semi-circular door 17 atop as shown in FIGS. 5 and 6. Door 17 is pivotally affixed to semi-circular stop 35 to rotate around axle 36 which passes through both stop 35 and door 17. Resilient member 24 preferably a coil spring, is attached and biases door 17 in a closed position.

Figure 3:
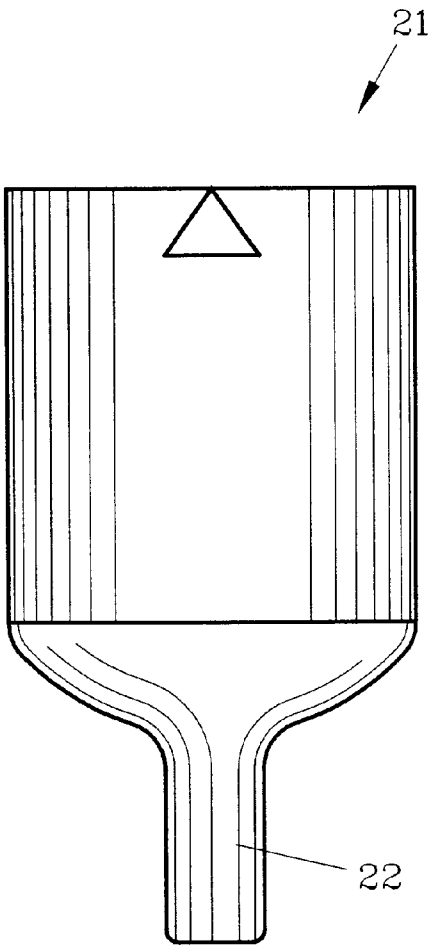
FIG. 3 features another embodiment of a paintball pod.
Figure 2:
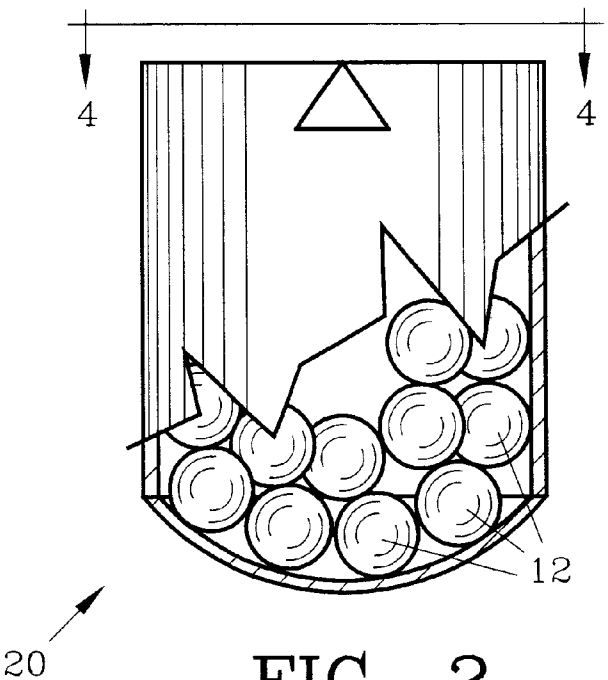
FIG. 2 demonstrates a paintball pod of the invention somewhat cut-away to illustrate paintballs therein.

As seen in FIG. 2, preferred pod 20 provides a container for approximately two hundred (200) paintballs 12 whereas alternative pod 21 in FIG. 3 includes handle 22 for easy carrying and use but may contain only one hundred fifty (150) paintballs 12 due to its smaller volume. Pod 21, like pod 20 has a top rotatable door (not seen in FIGS. 2 and 3).

Figure 4:
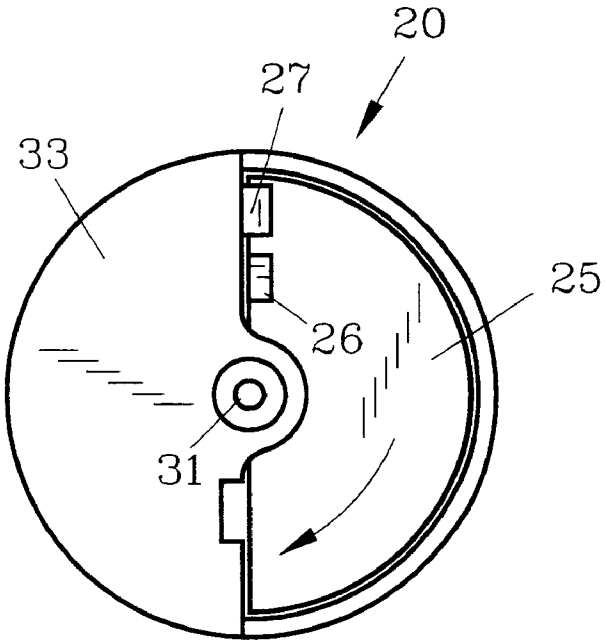
FIG. 4 depicts a top view of the paintball pod as shown in FIG. 2 along lines 4—4.

In FIG. 4, a top view of pod 20 is seen, (it being understood that pod 21 is constructed similarly) with rotatable door 25 closed. Upright door tab 26 is attached to door 25 and upright fixed tab 27 is attached to semi-circular stop 33. Door 25 is also semi-circular in shape and is urged into a closed position by resilient member 28 (preferably a coil spring) as seen in FIG. 6 which is attached to axle 31 and door 25.

Figure 7:
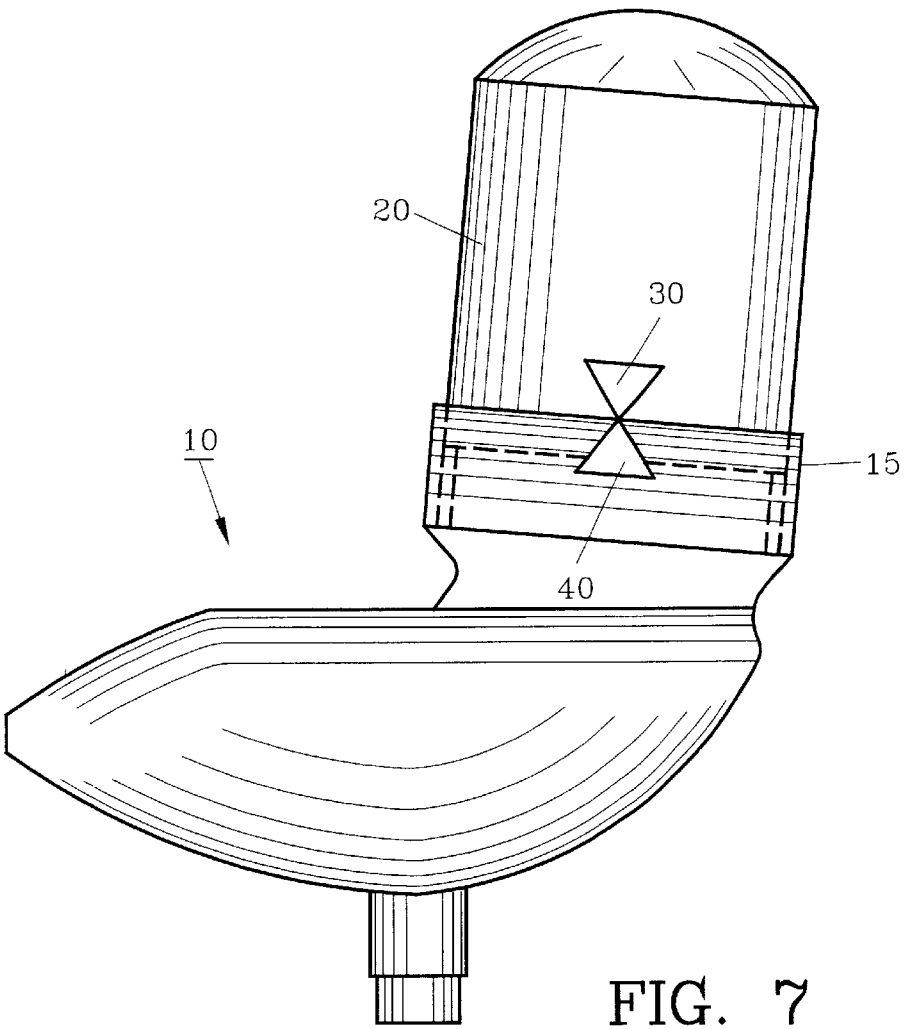
FIG. 7 illustrates the pod and magazine in full engagement before paintball transfer.

Pod 20 is shown inverted in FIG. 6 prior to engagement with magazine 10 so paintballs 12 contained within pod 20 can be quickly loaded into magazine 10. In FIG. 7, pod 20 is shown in full engagement with magazine 10 with indicator mark 30 on pod 20 in correct, vertical alignment with indicator mark 40 on magazine 10. Pod 20 is contained within collar 15 of magazine 10 which extends upwardly from body 16 about one-half inch (1.27 cm) as also seen in FIG. 6. Shoulder 32 positioned along the inside of collar 15 terminates the penetration of pod 20 into collar 15 and provides a rest for pod 20 during engagement and rotation on magazine 10.

Figure 8:
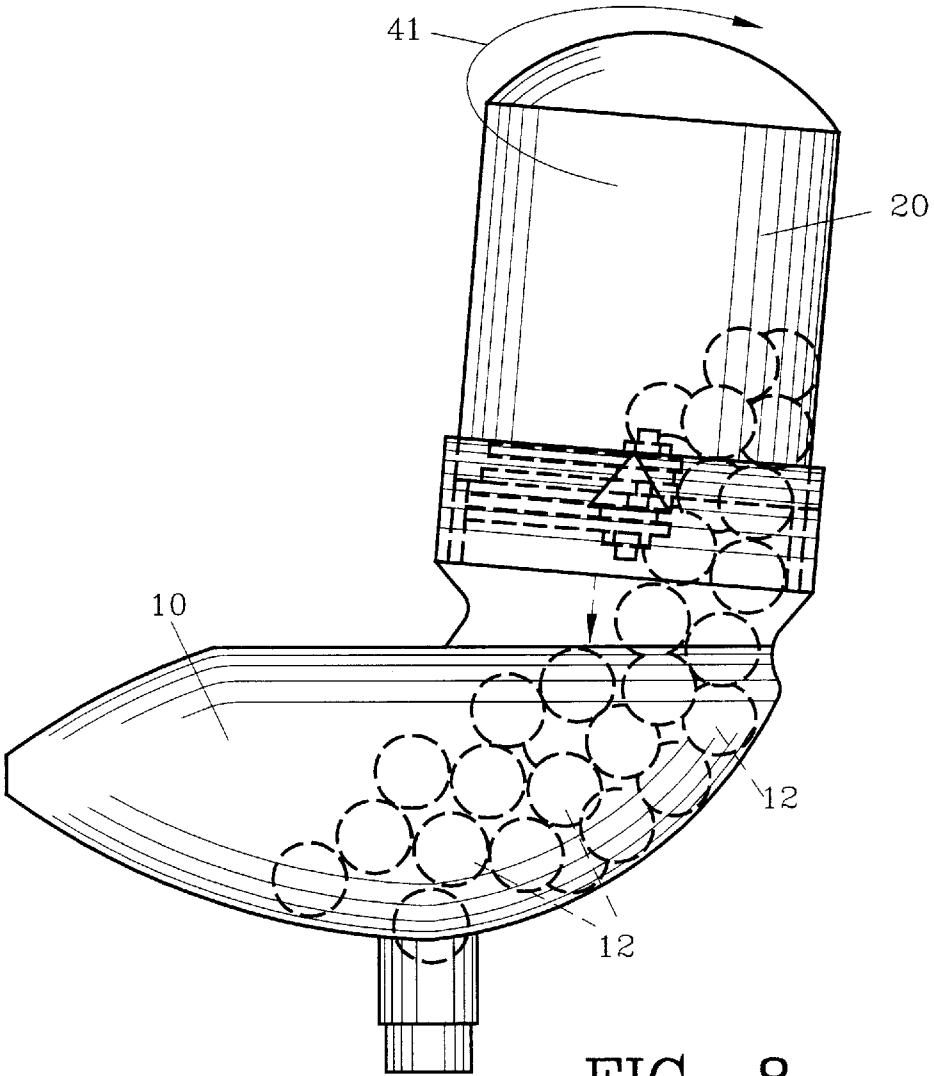
FIG. 8 shows the transfer of paintballs from the pod to the gun magazine.

The preferred method of transferring paintballs 12 from pod 20 to gun magazine 10 is carried out by indicator marks 30, 40 being aligned by sight as door 25 of pod 20 is inserted into collar 15, and pod 20 then resting on shoulder 32. Pod 20 is then manually rotated in a clockwise direction as shown by arrow 41 in FIG. 8 approximately 180°, whereby door 25 of pod 20 and door 17 of magazine 10 are simultaneously opened and coincidentally aligned to allow paintballs 12 within pod 20 to quickly flow by gravitational forces into magazine 10 to refill the same. Fixed pod tab 27 attached to stop 33 urges door tab 19 of magazine 10 in a clockwise direction as pod 20 is rotated (as seen in FIG. 8) to open door 17. Simultaneously, door 25 is opened as fixed tab 18 on stop 35 of magazine 10 contacts pod door tab 26 causing pod door 25 to open during clockwise rotation of pod 20 thereon.

Once pod 20 has been emptied, resilient members 24 and 28 urge doors 17, 25 closed and also urges pod 20 in a counterclockwise direction whereby pod 20 is then easily lifted from magazine 10. Magazine 10 has thus been loaded with two hundred paintballs in a matter of seconds, maintaining paintball gun 11 as shown in FIG. 1 effective and preventing down time. Thereafter, pod 20 can then be refilled by opening door 25 by applying finger pressure to door tab 26 and a fresh supply of paintballs 12 loaded for another magazine refilling cycle.

The illustrations and examples provided herein are for explanatory purposes and are not intended to limit the scope of the appended claims.

I claim:

1. A paintball container comprising: a body portion for holding paintballs, a rotatable door, said door attached to said body portion, a door tab, said door tab affixed to said door to open the same, and a fixed tab, said fixed tab spaced from said door.

2. The paintball container of claim 1 further comprising a collar, said collar attached to said body portion and extending above said door.

3. The paintball container of claim 2 further comprising a shoulder, said shoulder affixed inside said collar above said door.

4. The paintball container of claim 2 wherein said collar is cylindrically shaped.

5. The paintball container of claim 1 wherein said door is substantially semi-circular in shape.

6. The paintball container of claim 1 further comprising a resilient member, said resilient member attached to said door for biasing said door closed.

7. The paintball container of claim 1 wherein said fixed tab is spaced from said door tab.

8. The paintball container of claim 1 further comprising an axle, said door rotatably positioned on said axle.

9. The paintball container of claim 1 further comprising a door stop, said door stop attached to said body to limit the pivotal motion of said door.

10. The paintball container of claim 1 comprising a gun magazine.

11. The paintball container of claim 10 further comprising a feeder tube, said feeder tube attached to said body, said feeder tube for directing paintballs into a gun breech.

12. The paintball container of claim 1 comprising a paintball pod.

13. The paintball container of claim 12, further comprising a handle, said handle affixed to said pod.

14. A paintball magazine and pod in combination, said paintball magazine comprising:

a body portion for holding paintballs, a rotatable door, said door attached to said body portion, a door tab, said door tab affixed to said door to open the same and a fixed tab, said fixed tab spaced from said door, said pod comprising:

a body portion for holding paintballs, a rotatable door, said door attached to said body portion, a door tab, said door tab affixed to said door to open the same and a fixed tab, said fixed tab spaced from said door, whereby said pod can engage said magazine for rotation thereon to open said magazine and said pod doors simultaneously for transferring paintballs from said pod to said magazine.

15. The combination of claim 14 wherein said magazine door tab engages said fixed tab of said pod during rotation of said pod thereon.

16. The combination of claim 14 wherein said pod door tab engages said fixed tab of said magazine to open said pod door during rotation of said pod thereon.

17. A method of transferring paintballs to a paintball gun magazine having a rotatable door biased closed with a resilient member and having a fixed tab and a door tab, comprising the steps of:

a) contacting the door tab to urge the door open; and b) loading paintballs into the magazine through the open door.

18. The method of claim 17 further comprising the steps of: releasing the door and allowing the resilient member to urge the door closed.

19. The method of claim 17 wherein contacting the door comprises the step of contacting the door with an inverted paintball pod.

20. The method of claim 17 further comprising the step of removing the pod from the magazine.

* * * * *